US010897113B1

(12) United States Patent
Yu

(10) Patent No.: US 10,897,113 B1
(45) Date of Patent: Jan. 19, 2021

(54) LAMP CAP AND LAMP HOLDER THEREOF

(71) Applicant: NINGBO WELL ELECTRIC APPLIANCE CO., LTD., Ningbo (CN)

(72) Inventor: Guolin Yu, Ningbo (CN)

(73) Assignee: NINGBO WELL ELECTRIC APPLIANCE CO., LTD., Ningbo (CN)

( * ) Notice: Subject to any disclaimer, the term of this patent is extended or adjusted under 35 U.S.C. 154(b) by 0 days.

(21) Appl. No.: 16/664,858

(22) Filed: Oct. 26, 2019

(30) Foreign Application Priority Data

Jul. 29, 2019 (CN) ..... 2019 1 0690696

(51) Int. Cl.
*H01R 33/22* (2006.01)
*F21V 21/002* (2006.01)
*F21V 19/04* (2006.01)

(52) U.S. Cl.
CPC ..... *H01R 33/22* (2013.01); *F21V 19/04* (2013.01); *F21V 21/002* (2013.01)

(58) Field of Classification Search
None
See application file for complete search history.

(56) References Cited

U.S. PATENT DOCUMENTS 2,306,741 A * 12/1942 Miller ..... 200/51.09
3,827,003 A * 7/1974 Sullivan ..... H01R 33/22 439/665
6,652,305 B1 * 11/2003 DiFusco ..... H01R 31/06 439/255
2004/0157495 A1 * 8/2004 Cherian ..... H01R 33/22 439/666
2013/0012040 A1 * 1/2013 Cofini ..... H01R 33/0836 439/108

FOREIGN PATENT DOCUMENTS

CN 104315380 A * 1/2015
CN 108548160 A 9/2018
GB 1144352 A * 3/1969 ..... H01R 33/22
WO WO-8101082 A1 * 4/1981 ..... H01R 33/22
WO WO-2012176592 A1 * 12/2012 ..... H01R 33/94

* cited by examiner

*Primary Examiner* — Britt D Hanley

(57) ABSTRACT

A lamp cap can include: a metal shell; an insulating base disposed on the metal shell; an elastic connecting mechanism disposed on the insulating base, wherein the elastic connecting mechanism can include a first metal element connected to the insulating base, a second metal element disposed opposite to the first metal element, and a spring disposed between the first metal element and the second metal element and configured for supporting the second metal element and electrically communicating the first metal element and the second metal element, a main part of the second metal element can extend into the metal shell, when the main part of the second metal element is pressed by a threaded portion of a bulb, the spring can be compressed and the second metal element is movable relative to the insulating base.

9 Claims, 9 Drawing Sheets

LAMP CAP AND LAMP HOLDER THEREOF

CROSS-REFERENCE TO RELATED APPLICATIONS

This application claims all benefits accruing under 35 U.S.C. § 119 from China Patent Application No. 201910690696.8, filed on Jul. 29, 2019, in the CNIPA, the content of which is hereby incorporated by reference.

TECHNICAL FIELD

The present disclosure relates to a field of a lamp socket, and in especially, to a lamp cap and a lamp holder thereof.

BACKGROUND

A lamp holder is configured for assembling a bulb and electrically connected to the bulb, so that the bulb can work on the lamp holder.

In the prior art, a lamp holder including a lamp cap for electrically connecting with a threaded portion of the bulb are provided. The lamp cup can include a metal main body, an elastic piece and a casted insulator. The insulator can include a first upper portion, a first bottom portion, a protruding block and a through hole. The elastic piece can include a second upper portion, a second bottom portion and a connecting portion. The second bottom portion of the elastic piece can be matched with the protruding block of the insulator. The second upper portion of the elastic piece can be located on the first upper portion of the insulator. The connecting portion of the elastic piece can be clamped in the through hole of the insulator, and the insulator can be located on a middle part of a top end of the metal main body.

When the lamp cap is matched with the threaded portion on the bulb, the elastic piece can be specifically connected with a live wire end of the bulb, and a shell of the threaded portion regarded as a ground wire end is connected with the metal main body, thereby realizing an electrical connection between the threaded portion and a power source. It can be understood that the second bottom portion of the elastic piece is always fixedly connected with a positive electrode of the power source, so that the second upper portion of the elastic piece can always be electrically connected with the positive electrode of the power source. The second upper portion of the elastic piece often extends upward relative to the insulator. When the lamp cap is used, the second upper portion of the elastic piece may be bent outward by hand, or when the threaded portion of the bulb is screwed into the metal main body of the lamp cap, the second upper portion of the elastic piece contacting with the metal main body may occur, which will lead to a short circuit of the power source.

SUMMARY

The present disclosure provides a lamp cap and a lamp holder including the same.

The lamp cap can include: a metal shell; an insulating base disposed on the metal shell; an elastic connecting mechanism disposed on the insulating base, wherein the elastic connecting mechanism can include a first metal element fixedly connected to the insulating base, a second metal element disposed opposite to the first metal element, and a spring disposed between the first metal element and the second metal element and configured for supporting the second metal element and electrically communicating the first metal element and the second metal element, a main part of the second metal element can extend into the metal shell, when the main part of the second metal element is pressed by a threaded portion of a bulb, the spring can be compressed and the second metal element is movable relative to the insulating base.

The second metal element can further include an edge part which is disposed at a periphery of the main part, the second metal element can be in a hat-like structure, and an axis of the second metal element and an axis of the metal shell can be coincidental.

The insulating base can be provided with a limiting element coupled with the edge part of the second metal element for limiting the second metal element to the insulating base.

The main part of the second metal element can be provided with a concave surface for matching the threaded portion of the bulb.

The first metal element can be fixed on a side of the insulating base away from the metal shell by an interference fit manner.

The first metal element can include a plurality of zigzag structures and the first metal element can be fixed on insulating base by the plurality of zigzag structures.

The first metal element can be fastened to a side of the insulating base away from the metal shell by a snap connection manner.

The spring can be disposed between the second metal element and the first metal element in a compressed manner and can abut against the second metal element and the first metal element.

A through hole can be formed in a bottom of the metal shell and the insulating base can be fixed to the metal shell and at a position of the through hole in a molding manner.

The lamp holder can include the lamp cap and a power cord electrically connected to the lamp cap, a live wire of the power cord can be connected to the first metal element, and a ground wire of the power cord can be connected to the metal shell.

The elastic connecting mechanism can be composed of the second metal element; the spring and the first metal element can replace the elastic piece. The second metal element and the metal shell can always be separated, avoiding a short circuit of the circuit and ensuring safe use of the lamp holder.

DETAILED DESCRIPTION

The embodiments of the present disclosure are clearly and completely described in the following with reference to the accompanying drawings. The described embodiments of the present disclosure do not represent all embodiments. All other embodiments obtained by those skilled in the art based on the embodiments of the present disclosure without creative efforts are within the scope of the present disclosure.

All technical and scientific terms used herein have the same meaning as commonly understood by one skilled in the art to which this present disclosure belongs, except where it is specifically defined. The terminology used in the description of the present disclosure is for the purpose of describing particular embodiments and is not intended to limit the present disclosure.

The present disclosure provides a lamp cap and a lamp holder including the lamp cap. Referring to FIGS. 1 to 9, the lamp holder can be configured for receiving a bulb 200. The bulb 200 can include a threaded portion 201. The threaded portion 201 of the bulb 200 can be screwed into the lamp holder.

The lamp holder can include a lamp cap 10 and a power cord (not shown) electrically connected to the lamp cap 10. The power cord can include a live wire and a ground wire respectively connected to the lamp cap 10, thereby achieving electrical connection between the lamp cap 10 and the power cord.

Figure 1:
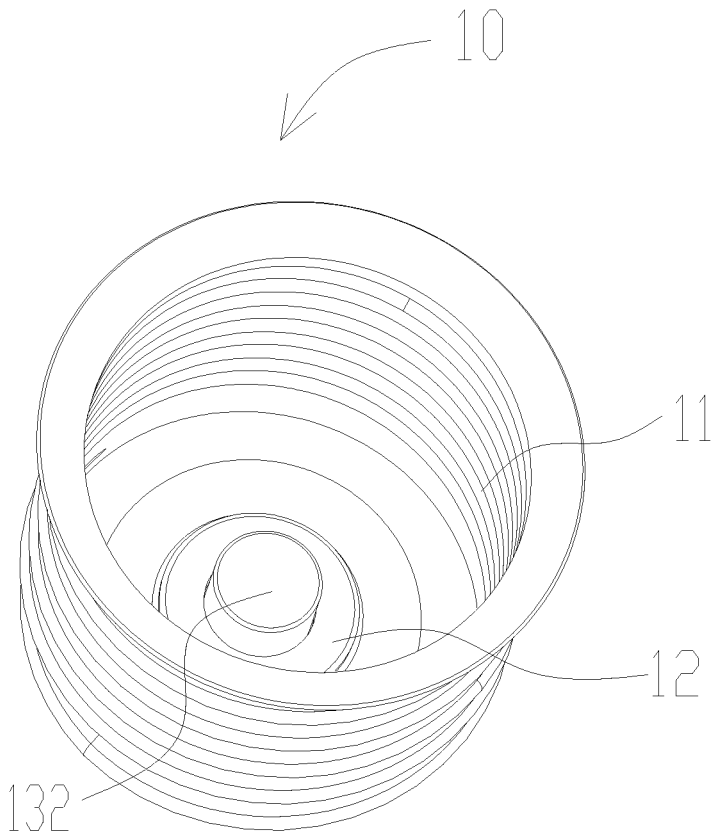
FIG. 1 is a perspective view of a lamp cap in an embodiment of the present disclosure.

In one embodiment, referring to FIG. 1, the lamp cap 10 can include a metal shell 11, an insulating base 12 disposed on the metal shell 11, and an elastic connecting mechanism 13 disposed on the insulating base 12.

Figure 3:
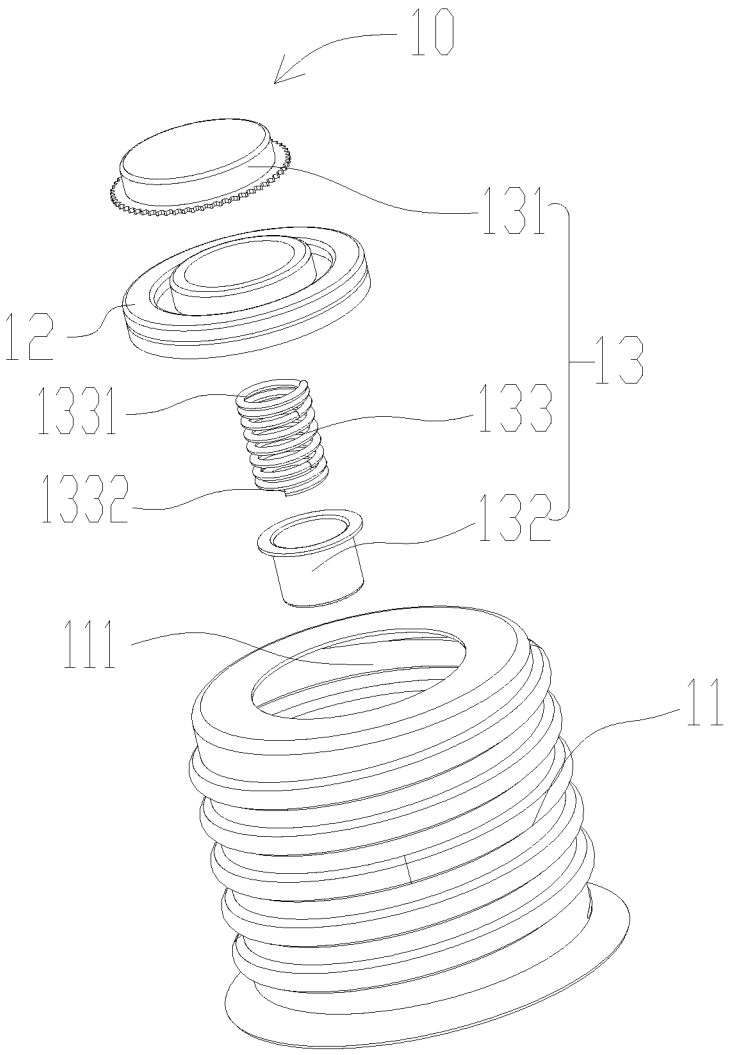
FIG. 3 is an exploded view of a lamp cap in an embodiment of the present disclosure.

Referring to FIG. 3, a through hole 111 can be formed on a bottom of the metal shell 11, and the insulating base 12 can be fixed to the metal shell 11 and at a position of the through hole 111 in a molding manner, thereby realizing a connection between the insulating base 12 and the metal shell 11.

Figure 2:
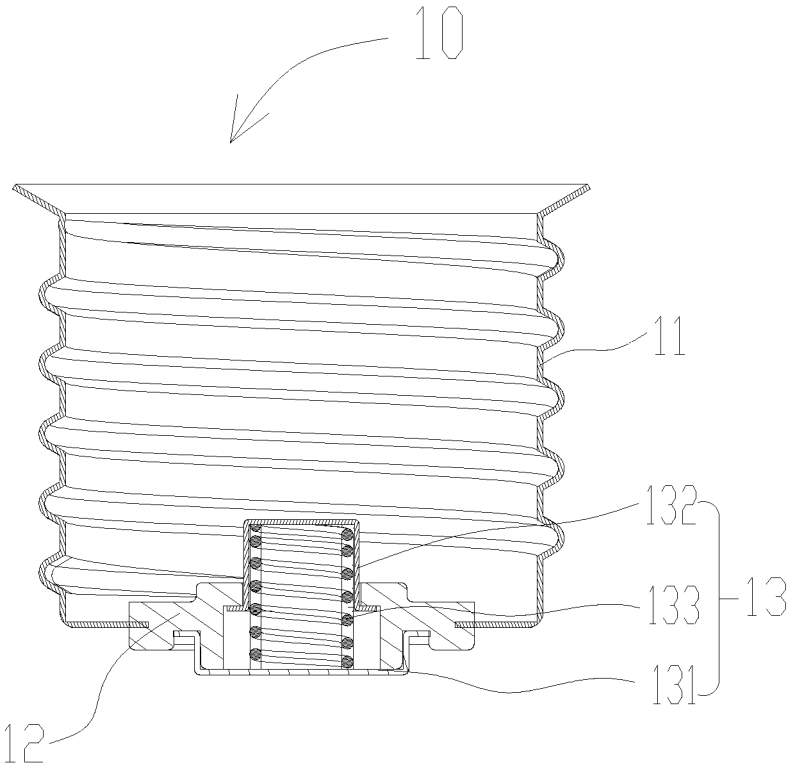
FIG. 2 is a cross-sectional view of a lamp cap in an embodiment of the present disclosure.

Referring to FIG. 2 and FIG. 3, the elastic connecting mechanism 13 can include a first metal element 131 fixedly connected to the insulating base 12, a second metal element 132 disposed opposite to the first metal element 131, and a spring 133 disposed between the second metal element 132 and the first metal elements 131. The second metal element 132, the spring 133 and the first metal element 131 can be sequentially connected, thereby electrically connecting the first metal element 131, the second metal element 132, and the spring 13. The elastic connecting mechanism 13 can be regarded as a whole structure.

The spring 133 can be disposed between the second metal element 132 and the first metal element 131 in a compressed manner and respectively abuts against the second metal element 132 and the first metal element 131. The second metal element 132 can be movably relative to the insulating base 12. A main part 1320 of the second metal element 132 can protrude into the metal shell 11. When the main part 1320 of the second metal element 132 is pressed by the threaded portion 201 of the bulb 200, the second metal element 132 will move toward the first metal element 131, the spring 133 will be compressed. That is, whatever the main part 1320 of the second metal element 132 is pressed or not pressed, the spring 133 is always in the compressed state and two ends of the spring 133 abut against the first metal element 131 and the second metal element 132 respectively. A live wire end 202 of the bulb 200 can abut against the second metal elements 132 and the threaded portion 201 can contact the metal shell 11 when the bulb 200 is assembled in the lamp cap 10 (referring to FIG. 9).

Figure 6:
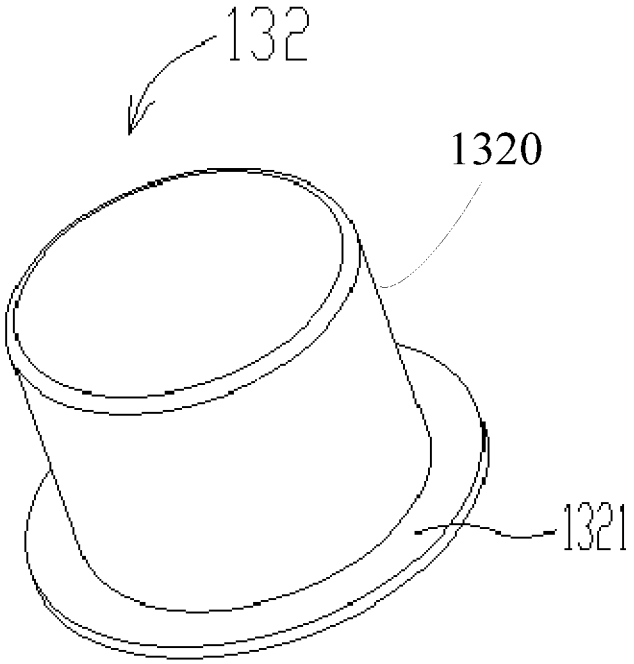
FIG. 6 is a perspective view of a second metal element of a lamp cap in an embodiment of the present disclosure.
Figure 7:
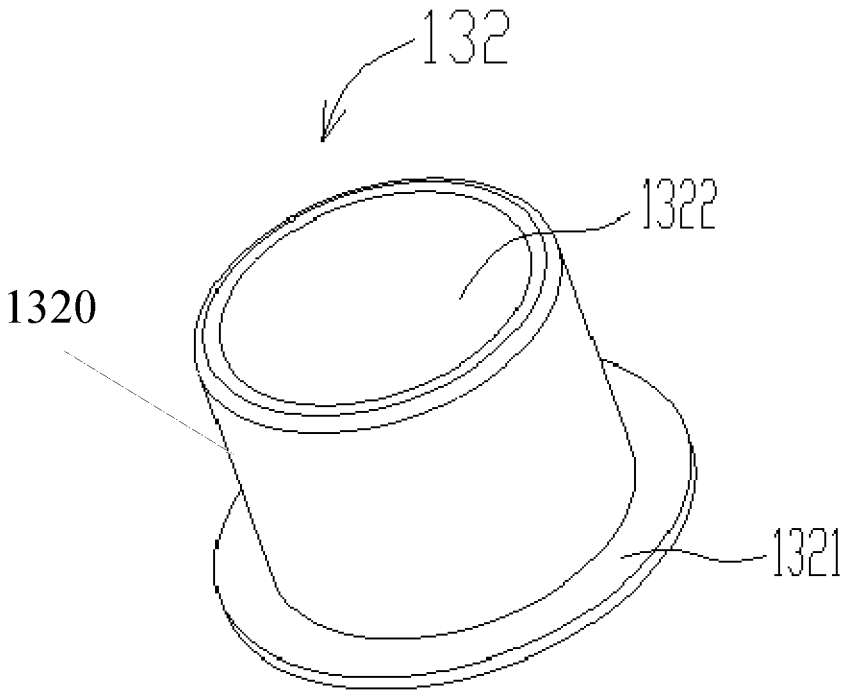
FIG. 7 is a perspective view of a second metal element of a lamp cap in another embodiment of the present disclosure.

In this embodiment, referring to FIG. 6, the second metal element 132 further includes an edge part 1321 which is disposed at a periphery of the main part 1320 and the second metal element 132 can be a hat-like structure. An axis of the second metal element 132 and an axis of the metal shell 11 can be coincidental to ensure a contacting area between the second metal element 132 and the live wire end 202 can be large enough when the two are in contact with each other. A maximum diameter of the contacting area can be greater than 5.4 mm to meet the requirements for contact and certification safety in the United States when the bulb 200 is assembled in the lamp bolder.

It can be understood that a surface of the second metal element 132 away from the first metal element 131 can be configured for abutting against the live wire end 202 of the bulb 200. In another embodiment, referring to FIG. 7, the surface of the second metal element 132 away from the first metal element 131 can be a concave surface 1322. When the bulb 22 is assemble in the lamp cap 10, the live wire end 202 of the bulb 200 contacts with the concave surface 1322 of the second metal element 132, thereby improving the contacting area between the second metal element 132 and the live wire end 202. In another embodiment, the entire surface of the second metal element 132 away from the first metal element 131 can be the concave surface 1322 according to matching requirement of the live wire end 202. In another embodiment, the surface of the second metal element 132 away from the first metal element 131 can be flat according to needs.

When the second metal element 132 is assembled to the insulating base 12, a peripheral wall of the main part 1320 of the second metal element 132 can abut against the insulating base 12, so that the second metal element 132 can be in a reciprocating motion along an axis of the insulating base 12. That is, the second metal element 132 can be always in a center position of the metal shell 11, when the threaded portion 201 of the bulb 200 is screwed into the metal shell 11, the live wire end 202 disposed in the center of the threaded portion 201 can contact with the second metal element 132.

Figure 4:
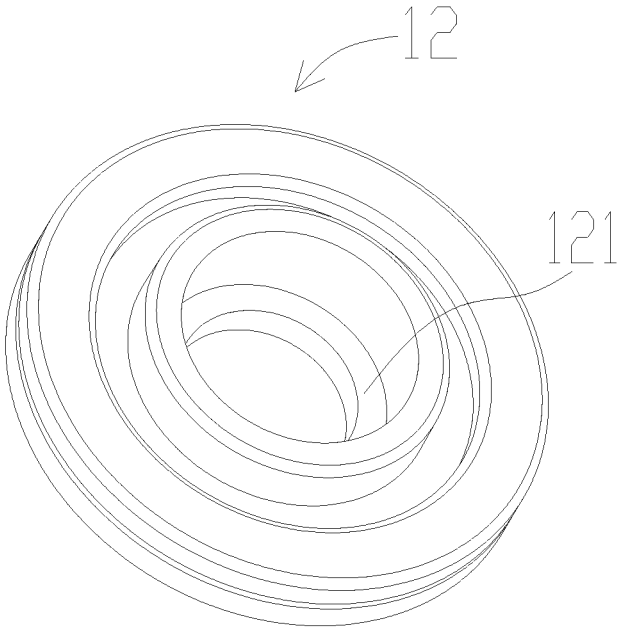
FIG. 4 is a perspective view of an insulating base of a lamp cap in an embodiment of the present disclosure.

Referring to FIG. 4, the insulating base 12 can be provided with a limiting element 121. The limiting element 121 can be coupled with the edge part 1321 of the second metal element 132 for limiting the second metal element 132 to the insulating base 12. Referring to FIG. 3, the spring 133 can include a first end 1331 abutting against the first metal element 131 and a second end 1332 abutting against the second metal element 132. The second metal element 132 is supported by the spring 133 and limited by the limiting element 121 at the same time. It should be noted that the limiting type between the second metal element 132 and the insulating base 12 is not limited to the structure shown in the drawing, and the limit element 121 can include a plurality of split arc structures spaced with each other, and the edge part 1321 of the second metal element 132 can also include arc structures spaced with each other correspondingly.

Referring to FIG. 2, the first metal element 131 can be fixed on one side of the insulating base 12 away from the metal shell 11 and the second metal element 132 and the spring 133 can be located on the other side of the insulating base 12. The live wire of the power cord can be connected to the first metal element 131 by soldering, and the ground wire of the power cord can be connected to the metal shell 11 by soldering, so that the second metal element 132 can be electrically connected to the live wire of the power cord. It should be noted that a connection between the first metal element 131 and the insulating base 12 is not limited to an interference fit. In another embodiment, referring to FIG. 8, the first metal element 131 can be buckled to the insulating base 12 according to needs. The insulating base 12 can be provided with buckles 122 for limiting the first metal element 131.

Figure 5:
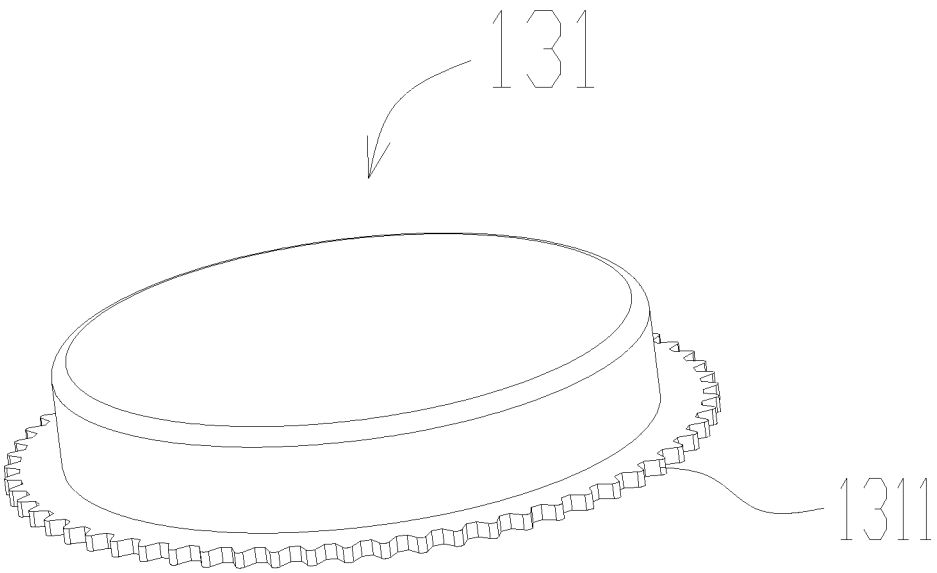
FIG. 5 is a perspective view of a first metal element of a lamp cap in an embodiment of the present disclosure.

Referring to FIG. 5, the first metal element 131 can include a plurality of zigzag structures 1311 or teeth around an outer perimeter and the first metal element 131 can be fixed on the insulating base 12 by the plurality of zigzag structures 1311. The first metal element 131 can be engaged with the insulating base 12 by the plurality of the zigzag structures 1311 in the interference fit manner. When the first metal element 131 is assembled on the insulating base 12, the first metal element 131 can be correspondingly disposed on the insulating base 12 by pressing the first metal element 131 to make the plurality of zigzag structure 1311 of the first metal element 131 cooperate with the insulating base 12 in the interference fit manner, thereby fixing the first metal element 131 to the insulating base 12. The first metal element 131 is connected with the insulating base 12 by the zigzag structures 1311, so that the structure of the insulating base 12 for mating with the first metal element 131 can be simplified, thereby facilitating the insulating base 12 disposing on the metal shell 11 by the injection molded manner.

Figure 8:
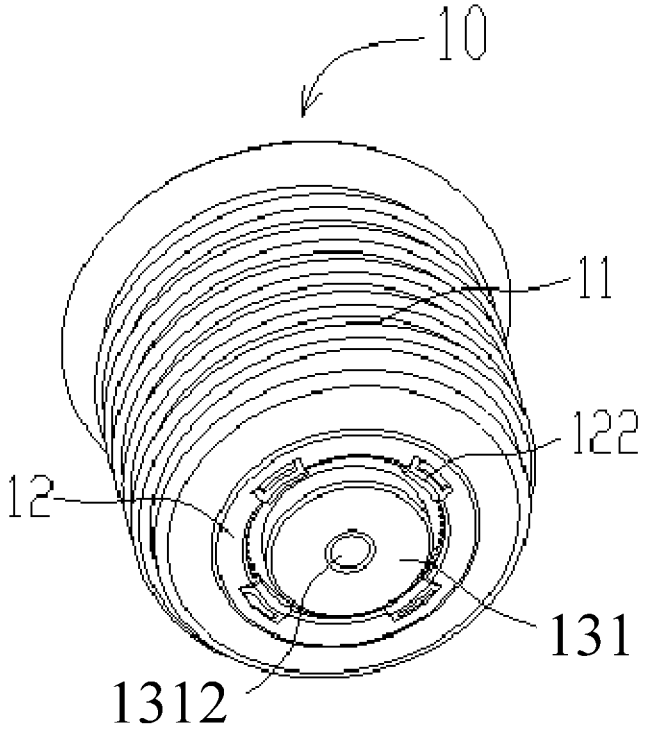
FIG. 8 is a perspective view of a lamp cap in another embodiment of the present disclosure.
Figure 9:
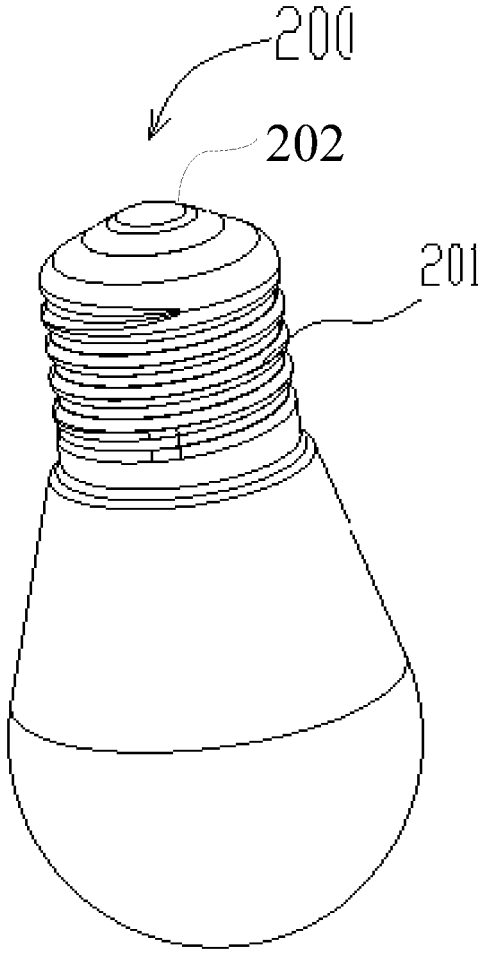
FIG. 9 is a perspective view of a bulb coupling with a lamp cap in the present disclosure.

In another embodiment, referring to FIG. 8, a side of the first metal element 131 away from the second metal element 132 can be provided with a positioning recess 1312, so that the first metal element 131 can be assembled on the insulating base 12 conveniently. The positioning recess 1312 can assemble the first metal element 131 on the insulating base 12 by a robot or machine. When the live wire of the power cord can be soldered to the positioning recess 1312 of the first metal element 131.

The spring 133 can be a compression spring and the second end 1332 of the spring 133 protruding into the second metal element 132 abuts against the peripheral wall of the second metal element 132, so as to ensure the spring 133 can contact the second metal element 132 on one hand, and on the other hand, the second metal element 132 can radially limit the spring 133 to prevent the spring 133 from being deflected and shaken. It should be noted that, in the present embodiment, a cross-sectional diameter of the spring 133 can be large to reduce a resistance of the spring 133, thereby improving a power supply of the lamp holder to the bulb 200.

In summary, for the lamp cap and the lamp holder provided by the present disclosure, the elastic connecting mechanism 13 composed of the second metal element 132, the spring 133 and the first metal element 131 can replace the elastic piece in the prior art. The second metal element 132 and the metal shell 11 can always be separated, avoiding a short circuit of the circuit and ensuring safe use of the lamp holder.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A lamp cap, comprising:

a metal shell;

an insulating base disposed on the metal shell; and an elastic connecting mechanism disposed on the insulating base, wherein the elastic connecting mechanism comprises a first metal element fixedly connected to the insulating base, a second metal element disposed opposite to the first metal element, and a spring disposed between the first metal element and the second metal element and configured for supporting the second metal element and electrically communicating the first metal element and the second metal element, a main part of the second metal element extends into the metal shell, when the main part of the second metal element is pressed by a threaded portion of a bulb, the spring is compressed and the second metal element is movable relative to the insulating base, the second metal element is a hat-like structure and has a hollow space for accommodating a part of the spring.

2. The lamp cap of claim 1, wherein the second metal element further comprises an edge part disposed at a periphery of the main part, and an axis of the second metal element and an axis of the metal shell are coincidental.

3. The lamp cap of claim 2, wherein the insulating base is provided with a limiting element coupled with the edge part of the second metal element for limiting the second metal element to the insulating base.

4. The lamp cap of claim 1, wherein the main part of the second metal element has a concave surface matching the threaded portion of the bulb.

5. The lamp cap of claim 1, wherein the first metal element is fixed on a side of the insulating base away from the metal shell by an interference fit manner.

6. The lamp cap of claim 5, wherein the first metal element comprises a plurality of zigzag structures and the first metal element is fixed on the insulating base by the plurality of zigzag structures.

7. The lamp cap of claim 1, wherein the first metal element is fastened to a side of the insulating base away from the metal shell by a snap connection manner.

8. The lamp cap of claim 1, wherein the spring is disposed between the second metal element and the first metal element in a compressed manner and respectively abuts against the second metal element and the first metal element.

9. A lamp holder comprising the lamp cap of claim 1 and a power cord electrically connected to the lamp cap, wherein a live wire of the power cord is connected to the first metal element, and a ground wire of the power cord is connected to the metal shell.

* * * * *